US007067090B2

(12) United States Patent
Han et al.

(10) Patent No.: US 7,067,090 B2
(45) Date of Patent: Jun. 27, 2006

(54) RECOVERY OF PLATINUM GROUP METALS

(75) Inventors: Kenneth N. Han, Rapid City, SD (US); Peter Nam-soo Kim, Rapid City, SD (US)

(73) Assignee: South Dakota School of Mines and Technology, Rapid City, SD (US)

( * ) Notice: Subject to any disclaimer, the term of this patent is extended or adjusted under 35 U.S.C. 154(b) by 535 days.

(21) Appl. No.: 10/280,714

(22) Filed: Oct. 25, 2002

(65) Prior Publication Data

US 2004/0081602 A1 Apr. 29, 2004

(51) Int. Cl.
*C22B 11/00* (2006.01)

(52) U.S. Cl. ..... 423/22; 75/744

(58) Field of Classification Search ..... 423/22; 75/744, 732; 502/24, 27, 56
See application file for complete search history.

(56) References Cited

U.S. PATENT DOCUMENTS 2,950,965 A * 8/1960 Hoekstra et al. ..... 423/22
5,114,687 A 5/1992 Han et al. ..... 423/32
5,308,381 A 5/1994 Han et al. ..... 75/744
5,328,669 A 7/1994 Han et al. ..... 423/32
5,542,957 A 8/1996 Han et al. ..... 75/732

OTHER PUBLICATIONS

Julius Scherzer, "Rare Earths in Cracking Catalysts," in *Rare Earths, Extraction, Preparation and Application* 317-331 (R.G. Bautista & M.M. Wong, Eds., TMS, 1988).
P.L. Sibrell et al.. "Leaching of Petroleum Catalyst with Cyanide for Palladium Recovery," in *Recycling of Metals and Engineering Materials* 121-130 (P B Queneau & R D Peterson Eds TMS 1995).
R.J. Kuczynski et al., "Recovery of Platinum Group Metals from Automobile Catalysts—Pilot Plant Operation," in *Recycling of Metals and Engineering Materials* 527-541 (P.B. Queneau & R.D. Peterson, Eds., TMS, 1995).

* cited by examiner

*Primary Examiner*—Steven Bos
(74) *Attorney, Agent, or Firm*—Gordon & Rees LLP

(57) ABSTRACT

This invention relates to the recovery of platinum group metals and, more particularly, to the recovery of platinum group metals from various sources by roasting the source material with one or more of sulfuric acid, a sulfate and/or a bi-sulfate and with one or more halogen salt. The roasted product is put in contact with a leaching solution to dissolve at least a portion of the platinum group metals, which then may be separated and recovered.

24 Claims, 1 Drawing Sheet

RECOVERY OF PLATINUM GROUP METALS

FIELD OF THE INVENTION

This invention relates to the recovery of platinum group metals and, more particularly, to the recovery of platinum group metals from various sources by roasting and leaching.

BACKGROUND

Platinum group metals (platinum, iridium, osmium, palladium, rhodium and ruthenium) are used in a multitude of ways in various industries, such as automobile, electrical and electronic, dental and medical, petroleum refining and numerous chemical industries. The major primary source of platinum group metals is from ores and complex ores frequently containing nonferrous metal sulfide deposits, such as Cu—Ni deposits. An increasingly important source of platinum group metals, especially in the United States, is that of secondary sources, particularly scrap of ceramics, glass, electrical components and spent catalysts, e.g., from petroleum refineries and automobile catalytic converters.

For example, about 45 million automobiles are scrapped worldwide every year, including more than 15 million in the United States alone. Many of these automobiles have catalytic converters containing platinum group metals in sufficient quantities to warrant recovery attempts. Approximately 60% of scrap catalytic converters are collected to recover platinum group metals at a recovery value of approximately $35–40 per catalytic converter.

Platinum group metals frequently are incorporated with rare earth elements, such as cerium, lanthanum and neodymium, which are imbedded into the catalyst matrix consisting primarily of aluminum and silicon oxides. Effective extraction of these rare earth elements usually facilitates the recovery of platinum group metals from these catalysts.

Because platinum group metals are regarded as chemically noble, their extraction from various source materials is relatively very difficult and very expensive. Aqua regia ($HCl/HNO_3$) and concentrated $HCl/Cl_2$ solutions have been used in the precious metals industry to put these metals into solution. However, these reagents are chemically strong. It is very difficult and expensive to safely and efficiently handle these reagents under the concentrations used in the industry.

Extracting platinum group metals from automobile catalysts is also relatively difficult and expensive, particularly due to the problems associated with handling the acids employed and the high cost of reagent consumption. The chemicals and methods commonly used to process these metals tend to dissolve even silica and alumina, which frequently make up the base matrix holding the platinum group metals. As a result, existing processes generally suffer from high acid consumption and severe acid corrosion problems.

A non-acidic process of dissolving platinum group metals has been introduced, which appears to be an improvement in metallurgical efficiency in some aspects. However, a major reactant of this non-acidic process is cyanide, a toxic chemical presenting its own handling, processing and disposal issues. This non-acidic process also suffers from relatively high reagent consumption and relatively low recovery of rhodium.

Researchers at the South Dakota School of Mines and Technology have developed certain technologies of extracting precious metals, including gold, silver, copper, nickel, rhenium and platinum group metals from ores and spent catalysts using ammonia and/or halogen salts. See, e.g., U.S. Pat. Nos. 5,114,687; 5,308,381; 5,328,669; and 5,542,957. In general, these processes involve the recovery of precious metals using environmentally benign processes. However, these process also generally involve higher temperatures and higher pressures, such as in an autoclave.

Therefore, a need exists for an improved process of recovering platinum group metals from a variety of sources.

SUMMARY OF THE INVENTION

This invention relates to the recovery of platinum group metals and, more particularly, to the recovery of platinum group metals from various sources by roasting the source material with one or more of sulfuric acid, a sulfate and/or a bi-sulfate and with one or more halogen salt, and by contacting the roasted product with a leaching solution.

DETAILED DESCRIPTION OF THE INVENTION

Figure 1:
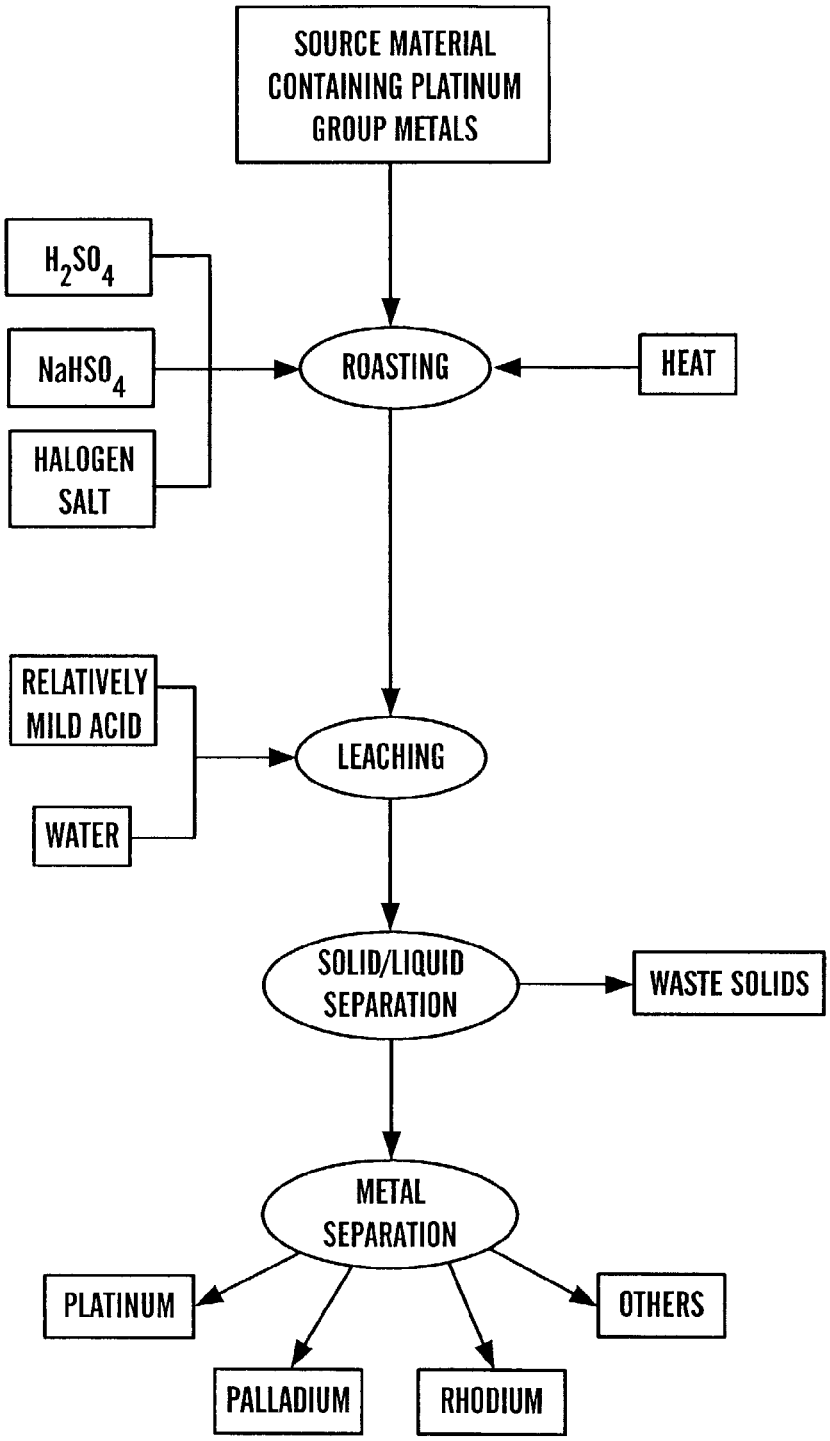
FIG. 1 is a flow chart depicting one embodiment of the invention.

Platinum group metals are extracted from primary sources, such as their native state and complex ores, and from secondary or other sources, such as refractory ores, automobile catalytic converters, and petroleum and chemical catalysts. In general, the metal or metal-containing source material is mixed with one or more of sulfuric acid, a sulfate or a bi-sulfate, and with one or more halogen salt. Water may be added to facilitate increased physical contact between the desired reactants in the roasting process. For example, a solution may be prepared comprising water, a halogen salt and one or more of sulfuric acid, a sulfate and a bi-sulfate. The solution is combined with the source material to form a roasting mixture. The resulting mixture is roasted and then subjected to leaching. Additional ingredients may be added. For example, the roasted product may also be subjected to leaching in the presence of oxidants to facilitate the dissolution reaction or sulfuric acid to extract certain chemicals, such as rare earth elements.

In one embodiment of the invention, the roasting mixture may be roasted at relatively modest temperatures, such as approximately 300° Celsius to approximately 1,000° Celsius, followed by leaching in a relatively mildly acidic solution and at a relatively low temperatures, such as less than the boiling point of water. Therefore, the extraction of these platinum group metals can take place without applying relatively high pressures, such as those in an autoclave, and without applying highly concentrated acids. The process is effective metallurgically, while still being relatively benign environmentally.

To prepare a quantity of source material for extracting platinum group metals, the source material may be crushed, preferably to a size of approximately less than 3 mesh, more preferably less than approximately 10 mesh, and even more preferably approximately 50 mesh. In the case of the source material being spent or partially spent catalysts, the platinum group metals desired to be extracted typically reside on or near the surface of the catalyst matrix. Crushing the source material typically increases the amount of surface area, the number of reaction sites, the rate of reaction and the relative amount of platinum group metal extracted, among other things. Alternatively, the source material is not required to be crushed, as long as the roasting mixture is capable of providing sufficient physical contact between the source material, the halogen salt, and the sulfuric acid, sulfate and/or bi-sulfate.

One or more of sulfuric acid, a sulfate or a bi-sulfate may be employed to form the roasting mixture. Sulfuric acid is a preferred ingredient, and more preferably concentrated sulfuric acid, which typically is 98% $H_2SO_4$. Alternatively, HCl or $HNO_3$, e.g., with sodium sulfate or potassium sulfate may be used.

As an alternative or in addition to sulfuric acid, a sulfate and/or a bi-sulfate may be used in the roasting mixture. Many types of sulfates and/or bi-sulfates may be employed, alone or in combination with others. Preferably, the sulfate is in the form of sodium, potassium or ammonium sulfates and most preferably is sodium sulfate. Preferably, the bi-sulfate is also in the form of sodium, potassium or ammonium bi-sulfates and most preferably is sodium bi-sulfate. Although bi-sulfates may be used, they generally are less preferred, because they are generally less efficient than the corresponding sulfate in removing platinum group metals from the source material. If added to the roasting mixture, sulfate and/or bi-sulfate is added in amounts sufficient to assist in the roasting process, and preferably approximately 5 grams to approximately 20 grams for every 100 grams of platinum group metal in the source material.

Another ingredient in the roasting mixture is one or more halogen salts, alone or in combination with others. Preferably, the halogen salt is in sodium, potassium or ammonium form, e.g., sodium, potassium or ammonium chlorides; sodium, potassium or ammonium bromides; sodium, potassium or ammonium iodides and mixtures thereof More preferably, chloride salts are used, due to their relatively lower cost and ready availability, although bromide, iodide and fluoride salts are also effective. Even more preferably, sodium chloride is used. Halogen salt is added in amounts sufficient to assist in the roasting process and preferably approximately 5 grams to approximately 20 grams for every 100 grams of platinum group metals in the source material.

The source material, at least one of sulfuric acid, a sulfate and/or a bi-sulfate and at least one halogen salt are combined to form a roasting mixture. Preferably, the roasting mixture forms a paste-like mixture. Alternatively, water may be added to the roasting mixture to increase the amount of physical contact between the source material, the halogen salt and the sulfuric acid, sulfate and/or bi-sulfate. Preferably, water is added in quantities sufficient to assist in carrying the halogen salt and the sulfuric acid, sulfate and/or bi-sulfate to all or substantially all of the surface area of the source material. More preferably, the water is added such that the resulting roasting material forms into a paste-like consistency.

If water is added, roasting the roasting material without first removing at least some of the water may result in the water bursting, which may result in loss of chemicals, unnecessary instant pressure and disruption of the process. Therefore, if water is added, preferably most of the water is removed from the roasting material before roasting. For example, the roasting material containing added water may be dried by adding heat, preferably approximately 60° Celsius to approximately 100° Celsius.

The roasting material is subjected to roasting, preferably at a temperature in the range of approximately 300° Celsius to approximately 1,000° Celsius, more preferably approximately 450° Celsius to approximately 700° Celsius, and even more preferably approximately 550° Celsius. The roasting time may vary from a few minutes to several days, depending on the size of the source material particles, the surface area of the source material particles, the manner in which the platinum group metals are attached to the source material particles, among other things. In a preferred embodiment where the source material is a crushed catalyst matrix mixed with sulfuric acid and sulfate, the roasting time preferably is approximately 30 minutes to approximately 60 minutes.

Although not being bound by any theory, it is believed that the roasting process facilitates the formation of platinum group metal compounds that are readily soluble, e.g., soluble in a relatively mild acidic solution. Additionally, the roasting process may loosen up the surrounding materials, such as rare earth elements, by chemical attach, which in turn may assist the extraction of platinum group metals. Other processes may also be occurring. Due to the number of variables, such as the physical and chemical nature of the source material, roasting may result in less than complete conversion to soluble platinum group compounds.

The roasted product is contacted with a leaching solution to dissolve, draw out or otherwise remove the platinum group metal compounds from solid mixture. Preferably, the leaching solution is an acidic solution, preferably approximately 0.5 pH to approximately 7.0 pH and more preferably approximately 1.0 pH. In applications involving platinum group metals, these levels of pH are relatively mildly acidic. A variety of acidic solutions may be employed, such as hydrochloric acid, nitric acid, sulfuric acid, halogen salt media, or ammonium salts. In a preferred embodiment, a leaching solution comprises a halogen solution of approximately 100 grams of $NH_4Br$, approximately 2.5 grams of $NH_4I$, approximately 25 ml of $H_2SO_4$ and approximately 0.5 grams of $I_2$, for every one liter of solution. In another embodiment, the leaching solution comprises HCl and $HNO_3$, preferably approximately 5% to approximately 10% each of HCl and $HNO_3$. Also, to facilitate the dissolution reaction of platinum group metals, an oxidant may be added. Preferably, the oxidant is a halogen element, such as chlorine, iodine, bromine and/or fluorine and more preferably is a mixture of iodine and a bromine.

After the platinum group metal compounds are leached out of the roasting product into the leaching solution, they may be separated by any number of ways, including electrowinning, cementation, solvent extraction, adsorption and/or chemical precipitation. Preferably, a combination of chemical precipitation and solvent extraction is used.

Sulfuric acid also may be added to the leaching solution to facilitate the extraction of platinum, palladium, rhodium, rhenium and rare earth elements from the roasted product. If sulfuric acid is added, preferably the roasted product and leaching solution are also heated to further facilitate the dissolution reaction, preferably to approximately 60° Celsius to approximately 100° Celsius and more preferably to approximately 90° Celsius. Although it is usually unnecessary, the roasted product and leaching solution may be subjected to heat treatment at approximately 110°–200° Celsius in an autoclave to accelerate the reaction rate or to reduce the reagent concentration.

In a typical demonstration of the invention, 100 grams of solid catalyst materials are mixed with 5 to 20 ml concentrated sulfuric acid and/or 5 to 20 grams of sodium, potassium, or ammonium sulfate and/or 5 to 20 grams of sodium, potassium, or ammonium bi-sulfate, 5 to 20 grams of sodium, potassium or ammonium halogen salts, including chloride, bromide, iodide or fluoride, and/or hydrogen chloride and 10 to 50 ml of water. The resulting slurry mixture is then heated to approximately 100° Celsius in an oven before subjecting to 300°–1,000° Celsius for approximately 30 minutes to approximately 60 minutes to form a roasted product.

The roasted product may then be subjected to leaching in a solution containing 10 to 40 ml of $HCl/HNO_3$ mixture into 500 ml solution and/or a solution containing ammonium halogen salts, oxidants and sulfuric acid. The preferred pH of the solution is between 0.5 and 7.0. Preferably, the concentration of halogen salts is approximately 0.01 to approximately 2 gram-moles per liter of solution and that of sulfuric acid is typically approximately 0.01 to approximately 1.0 gram-mole per liter, when it is needed. The temperature of the leaching solution is typically approximately 20° Celsius to approximately 100° Celsius, although it could be higher, e.g., approximately 200° Celsius or more to facilitate the reaction rate.

The following examples represent the results of numerous tests and results of a variety of source materials, other ingredients, conditions, and other variables. It will be understood that similar results could be attained with other conditions or combination of conditions, or with other ingredients or combination of ingredients, or with other changing other variables or combination of variables. The following examples are illustrative but are not limitations of the inventions disclosed herein.

EXAMPLE 1

In this example, the following quantities of the following ingredients were added to form a roasted mixture. This experiment represents a typical test of many similar experiments performed.

| Item | Ingredient | Quantity |
|---|---|---|
| A. | honeycomb type auto catalysts | 100 grams |
| B. | concentrated $H_2SO_4$ | 10 ml |
| C. | sodium chloride, NaCl | 10 grams |
| D. | water | 10 grams |

Item A was a ground material passing through a US standard screen of 20 mesh from spent automobile catalytic converters and consisted of 800 ppm of platinum, 260 ppm of palladium and 195 ppm of rhodium imbedded in an alumina-silicate matrix of honeycomb structure.

The above mixture was subjected to drying in an oven at 100° C. for 30 min. The dried product was then subjected to roasting at 1000° F. (538° C.) for 30 min. The roasted product was then subjected to dissolution in a 500 ml halogen salts solution (100 grams of $NH_4Br$, 2.5 grams $NH_4I$, 25 ml of $H_2SO_4$, 0.5 grams of 12; all of these chemicals in 850 grams of water) at 85° C. for 30 min. After 1 hour dissolution reaction, the solution was then separated from the solid by filtration.

The recovery of platinum, palladium and rhodium was evaluated by analyzing the contents of these metals in the solution using an Atomic Absorption Spectrophotometer/Induced Coupled Plasma. The solid residue was also analyzed by fire-assay to confirm the final recovery.

The recovery values of platinum, palladium and rhodium were found to be 90–98%, 95–99% and 90–98%, respectively. It was also noted that the recovery of ceria was about 70–80%.

Similar tests were also carried out using sodium, potassium or ammonium sulfate instead of sulfuric acid and hydrogen, potassium or ammonium chloride instead of sodium chloride and the metal recovery values obtained were very similar to what was obtained above.

EXAMPLE 2

In this example, the following quantities of the following ingredients were added to form a roasted mixture. This experiment represents a typical test of many similar experiments performed.

| Item | Ingredient | Quantity |
|---|---|---|
| A. | honeycomb type auto catalysts | 100 grams |
| B. | concentrated $H_2SO_4$ | 10 ml |
| C. | sodium chloride, NaCl | 10 grams |
| D. | water | 10 grams |

Item A was a ground material passing through a US standard screen of 20 mesh from spent automobile catalytic converters and consisted of 800 ppm of platinum, 260 ppm of palladium and 195 ppm of rhodium imbedded in an alumina-silicate matrix of honeycomb structure.

The above mixture was subjected to drying in an oven at 100° C. for 30 min. The dried product was then subjected to roasting at 1000° F. (538° C.) for 30 min. The roasted product was then subjected to dissolution in a 500 ml HCl and $HNO_3$ solution (20 ml concentrated HCl and 20 ml concentrated $HNO_3$ in 460 ml of water) at 85° C. for 30 min. After 1 hour dissolution reaction, the solution was then separated from the solid by filtration.

The recovery of platinum, palladium and rhodium was evaluated by analyzing the contents of these metals in the solution using an Atomic Absorption Spectrophotometer/Induced Coupled Plasma. The solid residue was also analyzed by fire-assay to confirm the final recovery.

The recovery values of platinum, palladium and rhodium were found to be 90–98%, 95–99% and 90–98%, respectively. It was also noted that the recovery of ceria was about 70–80%.

Similar tests were also carried out using sodium, potassium or ammonium sulfate instead of sulfuric acid and hydrogen, potassium or ammonium chloride instead of sodium chloride and the metal recovery values obtained were very similar to what was obtained above.

EXAMPLE 3

In this example, the following quantities of the following ingredients were added to form a roasted mixture. This experiment represents a typical test of many similar experiments performed.

| Item | Ingredient | Quantity |
|---|---|---|
| A. | honeycomb type auto catalysts | 100 grams |
| B. | sodium bi-sulfate | 5 grams |
| C. | concentrated $H_2SO_4$ | 5 ml |
| D. | water | 10 grams |

Item A was a ground material passing through a US standard screen of 60 mesh from spent automobile catalytic converters and consisted of 800 ppm of platinum, 260 ppm of palladium and 195 ppm of rhodium imbedded in an alumina-silicate matrix of honeycomb structure.

The above mixture was subjected to drying in an oven at 100° C. for 30 min. The dried product was then subjected to roasting at 1000° F. (538° C.) for 30 min. The roasted product was then subjected to dissolution in a 500 ml halogen salts solution (100 grams of $NH_4Br$, 2.5 grams $NH_4I$, 25 ml of $H_2SO_4$, 0.5 grams of $I_2$; all of these chemicals in 850 grams of water) at 85° C. for 30 min. After 1 hour dissolution reaction, the solution was then separated from the solid by filtration.

The recovery of platinum, palladium and rhodium was evaluated by analyzing the contents of these metals in the solution using an Atomic Absorption Spectrophotometer/Induced Coupled Plasma. The solid residue was also analyzed by fire-assay to confirm the final recovery.

The recovery values of platinum, palladium and rhodium were found to be 95%, 97% and 99%, respectively. It was also noted that the recovery of ceria was about 80%.

EXAMPLE 4

In this example, pure metals were used to demonstrate how the roasting of the metal affects the rate of dissolution of the metal later in the aqueous media. This experiment represents a typical test of many similar experiments performed.

| Item | Ingredient | Quantity |
|---|---|---|
| A. | pure rhodium metal | 0.2 grams |
| B. | sodium bi-sulfate | 2 grams |
| C. | concentrated $H_2SO_4$ | 3 ml |
| D. | water | 10 grams |

Item A was a rhodium powder purchased from Aldrich Chem. Co., Milwaukee, Wis. This rhodium powder was subjected to leaching in a standard aqua regia (3 conc HCl:1 conc $HNO_3$) and only 80% of the powder was dissolved at 70° C. after 3 hours leaching.

The rhodium metal powder was then mixed with the above chemicals as indicated and the mixture was subjected to drying in an oven at 100° C. for 30 min. The dried product was then subjected to roasting at 1000° F. (538° C.) for 30 min. The roasted product was then subjected to dissolution in a 100 ml halogen salts solution (20 grams of $NH_4Br$, 0.5 grams $NH_4I$, 5 ml of $H_2SO_4$, 0.1 grams of 12; all of these chemicals in 70 grams of water) at 85° C. for 30 min. After 1 hour dissolution reaction, the solution was then separated from the solid by filtration.

The recovery of rhodium was found to be nearly 100%.

EXAMPLE 5

In this example, the following quantities of the following ingredients were added to form a roasted mixture. It should be noted that this experiment is almost identical to those described in Examples 1 and 2, except that bromide and iodide salts were used instead of chloride salts.

| Item | Ingredient | Quantity |
|---|---|---|
| A. | honeycomb type auto catalysts | 100 grams |
| B. | concentrated $H_2SO_4$ | 10 ml |
| C. | mixture of equal amount of $NH_4Br$ and $NH_4I$ | 10 grams |
| D. | water | 10 grams |

Item A was a ground material passing through a US standard screen of 20 mesh from spent automobile catalytic converters and consisted of 800 ppm of platinum, 260 ppm of palladium and 195 ppm of rhodium imbedded in an alumina-silicate matrix of honeycomb structure.

The above mixture was subjected to drying in an oven at 100° C. for 30 min. The dried product was then subjected to roasting at 1000° F. (538° C.) for 30 min. The roasted product was then subjected to dissolution in a 500 ml HCl and $HNO_3$ solution (20 ml concentrated HCl and 20 ml concentrated $HNO_3$ in 460 ml of water) at 85° C. for 30 min. After 1 hour dissolution reaction, the solution was then separated from the solid by filtration.

The recovery of platinum, palladium and rhodium was evaluated by analyzing the contents of these metals in the solution using an Atomic Absorption Spectrophotometer/Induced Coupled Plasma. The solid residue was also analyzed by fire-assay to confirm the final recovery.

The recovery values of platinum, palladium and rhodium were found to be 90–98%, 95–99% and 90–98%, respectively. It was also noted that the recovery of ceria was about 70–80%.

The foregoing discussion of the invention has been presented for purposes of illustration and description. The foregoing is not intended to limit the invention to the form or forms disclosed herein. In the foregoing Detailed Description for example, various features of the invention are grouped together in one or more embodiments for the purpose of streamlining the disclosure. This method of disclosure is not to be interpreted as reflecting an intention that the claimed invention requires more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate preferred embodiment of the invention.

Moreover though the description of the invention has included description of one or more embodiments and certain variations and modifications, other variations and modifications are within the scope of the invention, e.g. as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

We claim:

1. A method of recovering a platinum group metal from a source material, comprising the steps of:

a) mixing a source material comprising a platinum group metal with at least one selected from the group consisting of sulfuric acid, a sulfate and a bi-sulfate, and with at least one halogen salt to form a roasting mixture;

b) heating the roasting mixture to a temperature in the range of approximately 450° C. to approximately 700° C. to form a roasted product;

c) contacting the roasted product with a leaching solution to dissolve at least a portion of the platinum group metal into the leaching solution; and d) recovering at least a portion of the platinum group metal from the leaching solution.

2. The method of claim 1, wherein the sulfate is selected from the group consisting of sodium sulfate, potassium sulfate and ammonium sulfate.

3. The method of claim 1, wherein the bi-sulfate is selected from the group consisting of sodium bi-sulfate, potassium bi-sulfate and ammonium bi-sulfate.

4. The method of claim 1, wherein the halogen salt is selected from the group consisting of sodium chloride, potassium chloride, ammonium chloride, sodium bromide, potassium bromide, ammonium bromide, sodium iodide, potassium iodide and ammonium iodide.

5. The method of claim 1, wherein the roasting mixture is heated to a temperature of approximately 550°C.

6. The method of claim 1, wherein the leaching solution has a pH of approximately 0.5 to approximately 7.

7. The method of claim 1, wherein the leaching solution comprises at least one of hydrochloric acid, nitric acid, sulfuric acid, halogen salt media, and ammonium salts.

8. The method of claim 1, further comprising adding water to the roasting mixture before heating the roasting mixture.

9. The method of claim 1, further comprising adding water to the roasting mixture and removing at least some of the water from the roasting mixture before heating.

10. The method of claim 1, wherein the leaching solution comprises an oxidant.

11. The method of claim 1, wherein the leaching solution comprises at least one oxidant selected from the group consisting of chlorine, iodine and bromine.

12. A method of separating a platinum group metal from a source material, comprising the steps of:

a) combining a source material comprising at least one platinum group metal with a solution comprising water, at least one halogen salt, and at least one selected from the group consisting of sulfuric acid, a sulfate and a bi-sulfate to form a roasting mixture;

b) heating the roasting mixture to a temperature of approximately 450° C. to approximately 700° C. to form a roasted product;

c) contacting the roasted product with a leaching solution having a pH of approximately 0.5 to approximately 7; and d) separating at least a portion of the platinum group metal from the leaching solution.

13. The method of claim 12, wherein the sulfuric acid is concentrated sulfuric acid.

14. The method of claim 12, wherein the sulfate is selected from the group consisting of sodium sulfate, potassium sulfate and ammonium sulfate.

15. The method of claim 12, wherein the bi-sulfate is selected from the group consisting of sodium bi-sulfate, potassium bi-sulfate and ammonium bi-sulfate.

16. The method of claim 12, wherein the halogen salt is selected from the group consisting of sodium chloride, potassium chloride, ammonium chloride, sodium bromide, potassium bromide, ammonium bromide, sodium iodide, potassium iodide and ammonium iodide.

17. The method of claim 12, wherein the leaching solution has a pH of approximately 1.

18. The method of claim 12, wherein the leaching solution comprises at least one of hydrochloric acid, nitric acid, sulfuric acid, halogen salt media, and ammonium salts.

19. The method of claim 12, further comprising removing at least some of the water from the roasting mixture before heating the roasting mixture.

20. The method of claim 12, wherein the leaching solution comprises an oxidant.

21. The method of claim 12, wherein the leaching solution comprises at least one oxidant selected from the group consisting of chlorine, iodine and bromine.

22. A method of recovering platinum group metals from a catalyst matrix, comprising the steps of:

a) crushing a catalyst matrix containing at least one platinum group metal;

b) mixing the crushed catalyst matrix with one or more selected from the group consisting of sulfuric acid, a sulfate and a bi-sulfate, with at least one halogen salt and with water to form a roasting mixture;

c) roasting the roasting mixture at a temperature of approximately 450° C. to approximately 700° C. to form a roasted product;

d)contacting the roasted product with an acidic leaching solution;

e)separating the non-dissolved solids from the leaching solution; and f) recovering at least a portion of the platinum group metal from the leaching solution.

23. The method of claim 22, further comprising removing at least a portion of the water from the roasting mixture before roasting.

24. The method of claim 22, wherein the roasting mixture is heated to a temperature of approximately 550° C.

* * * * *